US005735594A

United States Patent [19]

Own

[11] Patent Number: 5,735,594

[45] Date of Patent: Apr. 7, 1998

[54] FLASHLIGHT

[76] Inventor: James Own, 5Fl., No. 12, Lane 240, Jien Shan Rd., Yin-Ko Chen, Taipei Hsien, Taiwan

[21] Appl. No.: 774,439

[22] Filed: Dec. 30, 1996

[51] Int. Cl.[6] ..... F21L 11/00

[52] U.S. Cl. ..... 362/202; 362/188; 362/205

[58] Field of Search ..... 362/187, 202, 362/205, 208, 277, 280, 188, 282

[56] References Cited

U.S. PATENT DOCUMENTS

| | | | |
|---|---|---|---|
| 4,307,439 | 12/1981 | Sassmannshansen | 362/202 |
| 4,609,976 | 9/1986 | Geissler | 362/202 |
| 4,881,158 | 11/1989 | Price, III | 362/205 |

*Primary Examiner*—Y. My Quach
*Attorney, Agent, or Firm*—Bacon & Thomas

[57] ABSTRACT

A flashlight which includes a telescopic assembly for shade and a positioning assembling for a switch socket is provided. The telescopic assembly is facilitated by the slidable engagement between spiral grooves disposed at an outer wall of the headlight housing and projected bosses of the shade. When the shade is rotated, the shade is moved along the spiral grooves to extend or retract. The positioning assembly of the switch socket comprises a switch socket, a biasing plate and a water proof push button. The switch socket assembly is positioned by application of biasing plate. Consequently, excellent positioning and water proof effect are attained. The shade of the flashlight can be readily adjusted to move in for application of spotting an object or move out for application of a traffic signal baton.

4 Claims, 7 Drawing Sheets

FLASHLIGHT

FIELD OF THE INVENTION

The present invention relates to a flashlight, more particularly, to a flashlight wherein the shade can be telescopically adjusted and a new design has been incorporated to the positioning of the water-proof switch.

DESCRIPTION OF PRIOR ART

Traditionally, the flashlight may only provide an illuminating effect. When a warning effect is incorporated, for example, a flashtube or warning light, then the head portion of the flashlight is adjusted telescopically. There is a design wherein the head portion of the flashlight is provided with guiding tabs and the inner wall of the transparent shade is provided with recessed grooves corresponding to that of guiding tabs. Consequently, the transparent shade can be adjusted telescopically on said head portion. In the water-proof flashlight, water seal shall be provided between the switch and the barrel of the flashlight. As a result, the water may not penetrate into the flashlight. In the latter case, the switch base is configured by two upper and lower tubular column halves. The longitudinal cross sectional surface between the columns defines an inclined angle. In assembling, the upper half is disposed within the barrel of the flashlight firstly, then the lower half is attached to the upper half by a screw member such that the inclined cross section is biased towards the upper half tubular column. As a result, the switch is disposed within the barrel of the flashlight. Then a water seal gasket is pressed against the mounting hole of the barrel of the flashlight to provide a water seal.

SUMMARY OF THE INVENTION

It is an object of this invention to provide a design of flashlight wherein the transparent shade is adjusted and moved spirally along the head portion. By this arrangement, the transparent shade can be readily and smoothly adjusted and rotated. On the other hand, front and rear dead points provide an excellent positioning effect such that the resulting position of the transparent shade will not be easily shifted. On the other hand, the water seal will not be affected during the adjustment of the transparent shade.

It is still the object of this invention to provide a flashlight wherein the positioning means of the water proof switch socket can be readily and securely mounted within the barrel of the flashlight. It has a simple and compact configuration for assembling and superior water proof function.

DETAILED DESCRIPTION OF PREFERRED EMBODIMENT

Figure 1:
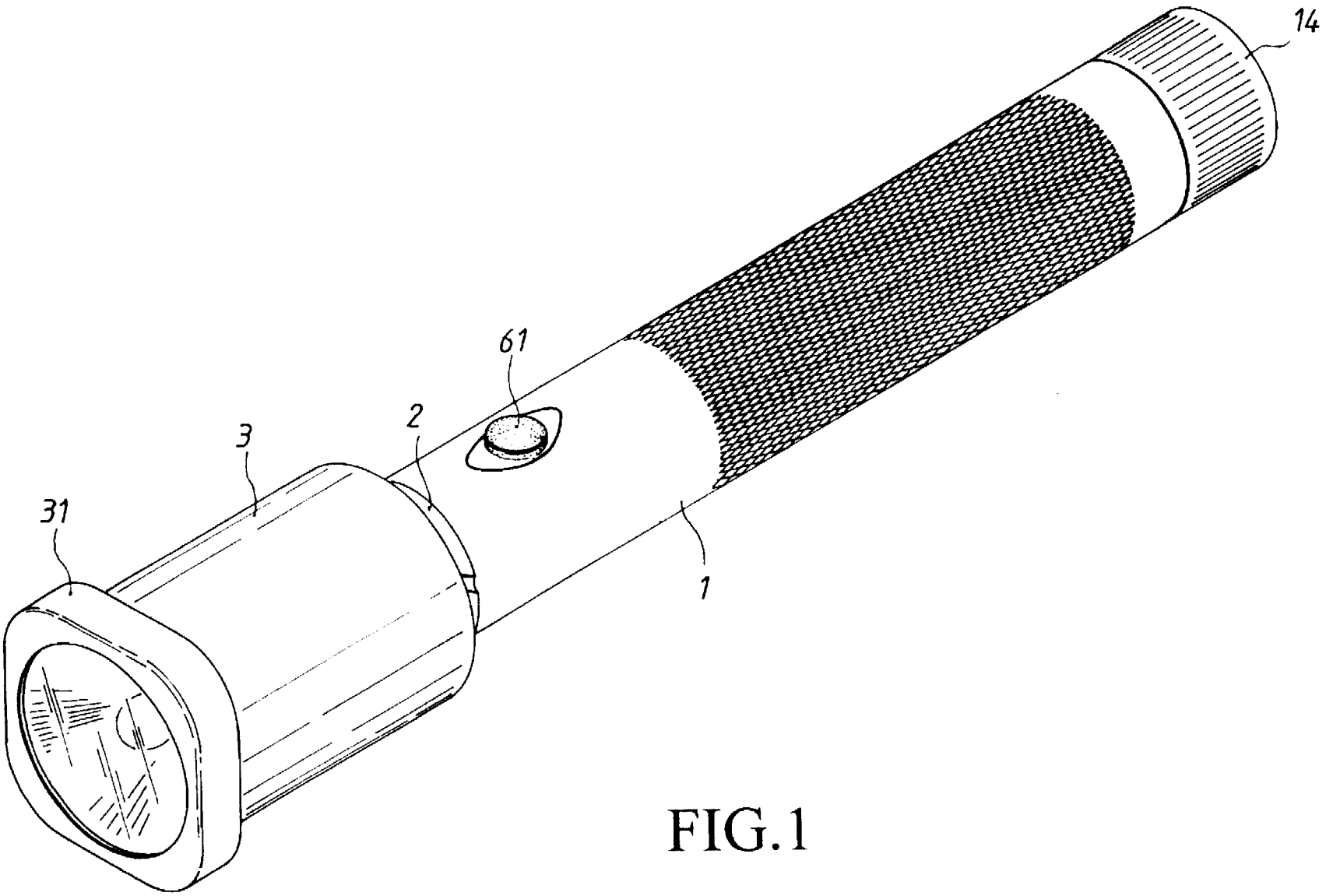
FIG. 1 is a perspective view of the flashlight made according to this invention.
Figure 2:
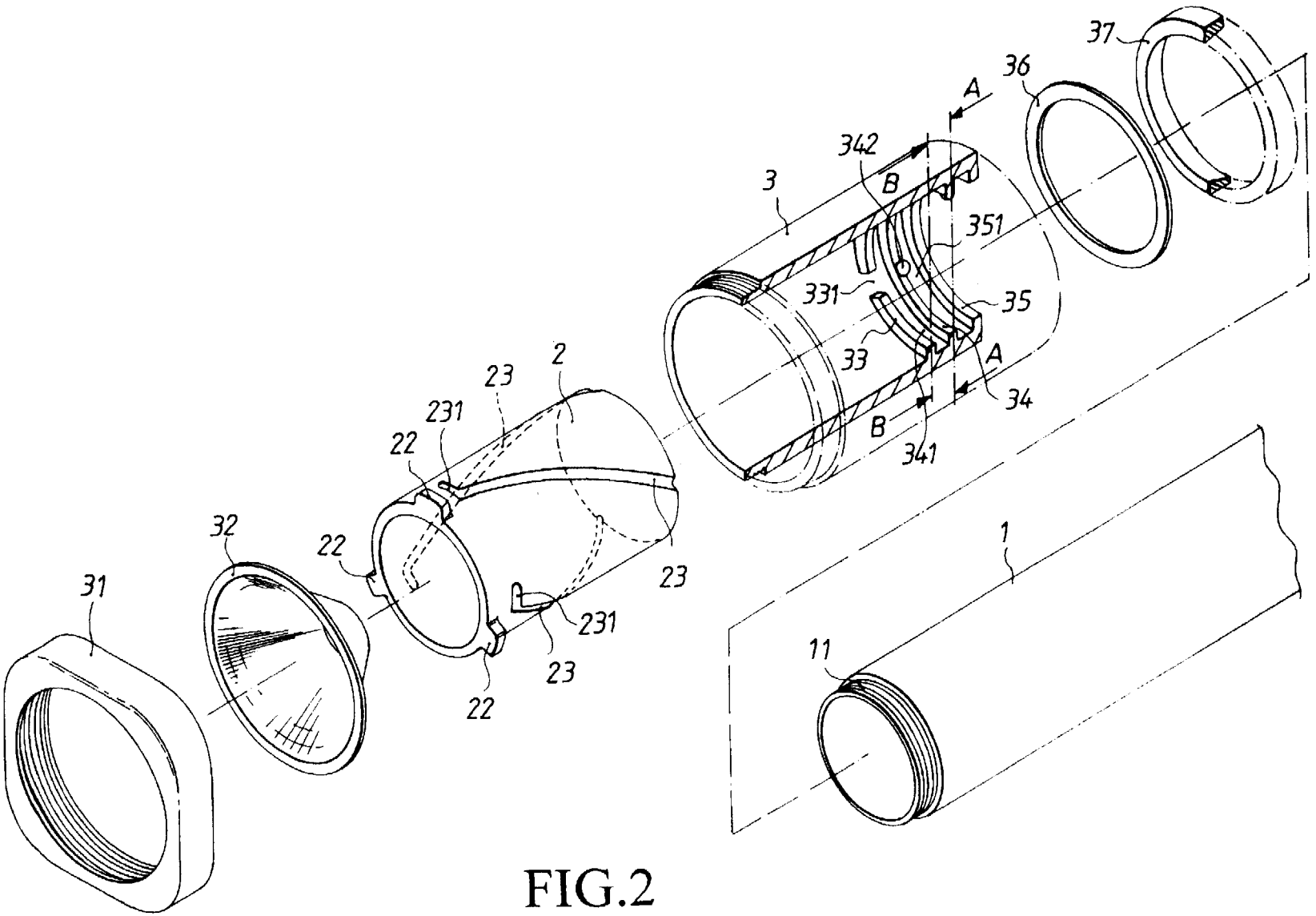
FIG. 2 is an exploded perspective view showing the adjusting means of the transparent shade.

Referring to FIG. 1, the flashlight made according to this invention generally comprises a telescopic assembly for shade and a positioning assembly for a water proof switch socket. The telescopic assembly includes a flashlight barrel 1, a headlight housing 2, and a shade 3. Wherein:

The flashlight barrel 1 has a threaded portion 11 at the front tip for releasable engagement with the headlight housing 2. The barrel 1 has stepped a pair of chambers 12, 12'. A push button hole 13 is disposed at the stepped hole 12. A cover 14 is removably attached to the rear end of the barrel 1.

The headlight housing 2 has a tubular configuration having an inner threaded portion 21 at the rear end. Three projected tabs 22 are spaced around the front end portion. The outer wall is provided with three spiral grooves 23 extending lengthwise. Each of the spiral grooves 23 is provided with a retaining slot 231.

Figure 3:
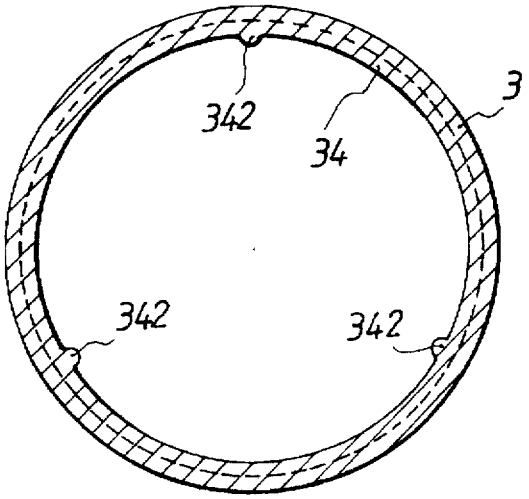
FIG. 3 is a cross sectional view taken along line A—A in FIG. 2.
Figure 4:
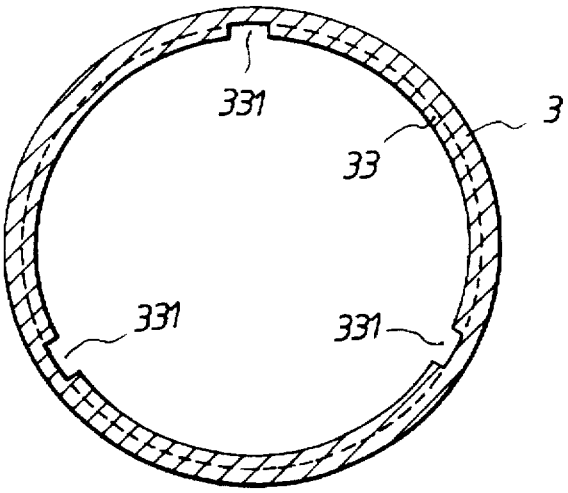
FIG. 4 is a cross sectional view taken along line B—B in FIG. 2.

The shade 3 has a hollow configuration and is made from transparent material. The outer wall is provided with a threaded portion for attaching a shade cover 31 thereto. A reflective mask 32 having a conical shape is attached to the shade by the shade 3 and cover 31. Three space circumferential projected ribs 33, 34 and 35 are disposed at the inner wall adjacent to the rear end of the shade 3 for defining two grooves 341, 351 therebetween. The grooves 341, 351 are provided with a gasket 36 and a rubber ring 37 respectively. The projected rib 33 is provided with three cutouts 331 which are equiangularly disposed along the projected rib 33, as clearly shown in FIG. 4. The second projected rib 34 is provided with three projected bosses 342, equiangularly disposed along projected rib 34 as clearly shown in FIG. 3.

The positioning assembly of the water proof switch socket comprises a switch socket 4, a biasing plate 5 and a water proof push button plate 6 which are jointly assembled within the stepped chamber 12 of the barrel 1.

The front portion of the switch socket 4 has a bulb socket 41 and a bulb 411 installed at a front portion of socket 41. The other end portion of the switch socket 4 is connected to the battery. A recessed portion 42 is disposed at the inner wall of the socket a adjacent to the end portion. The recessed portion 42 is provided with a push button receiving hole 43 in the central portion such that the push button element 44 extends beyond the push button receiving 43 and a retaining ring 441 is applied to lock it. A divergent stepped wall 45, 45' is disposed at the front and rear portion of the inner wall of the housing. Each of the divergent stepped wall 45, 45' is provided with a slot 451,451'.

A biasing plate 5 has a semicircular configuration. The central portion of the plate 5 is disposed with a projected rib 51 defining a groove 511 at the opposite side. The free ends are folded outward to form a flap 52, 52' respectively thereof.

The water proof push button plate 6 has a projected button 61 in the central portion and is disposed above the recessed portion 42 of the switch socket 4.

In assembling the telescopic assembly made according to this invention. The gasket 36 and rubber ring 37 are disposed within the grooves 341, 351. Then the headlight housing 2 is inserted into the shade 3 from the front portion. When the headlight housing 2 is correctly positioned, the spiral grooves 23 are aligned and slidably meshed with the projected bosses 342 of the projected rib 34. Then the rear portion of the headlight housing 2 extends to the rear end of the shade 3 such that the projected tabs 22 pass through the cutouts 331 of the first projected rib 33 and stopped within the groove 341. Then the headlight housing 2 can be locked to the barrel 1 of the flashlight by the engagement between the inner threaded portion 21 of housing 2 and outer threaded portion 11 of the barrel 1. Furthermore, a reflective mask 32 is disposed in the front portion of the shade 3 and retained by applying a shade cover 31. Then the telescopic assembly is finished.

Figure 5:
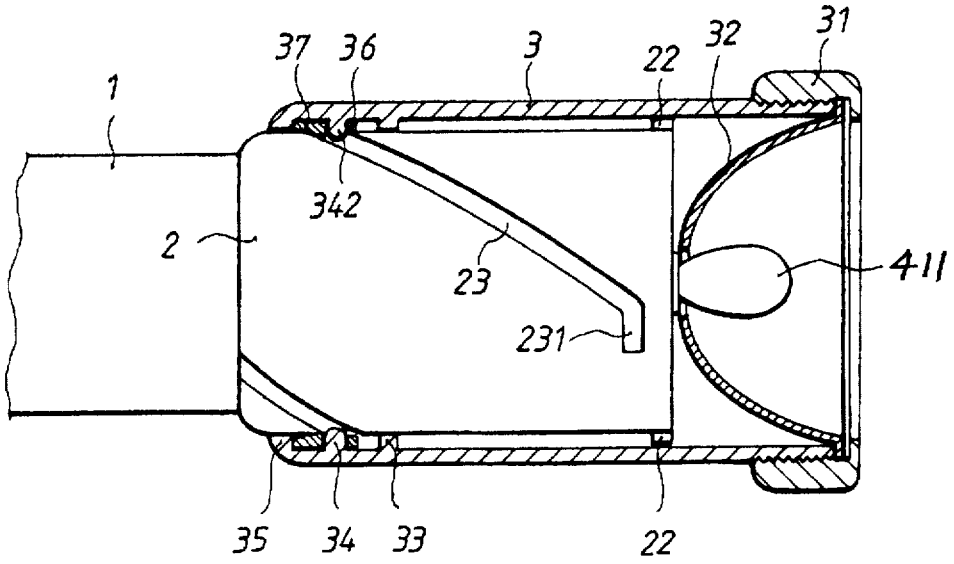
FIG. 5 is a cross sectional schematic illustration showing the shade is rotated to a backward position.
Figure 6:
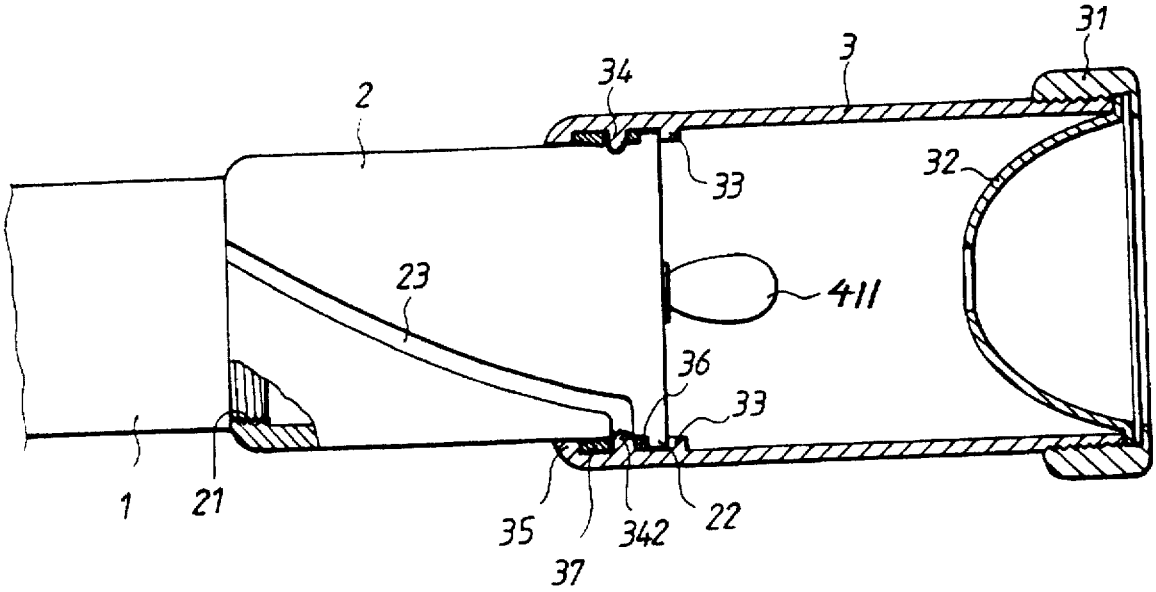
FIG. 6 is similar to FIG. 5 but with the shade rotated to a forward position.
Figure 7:
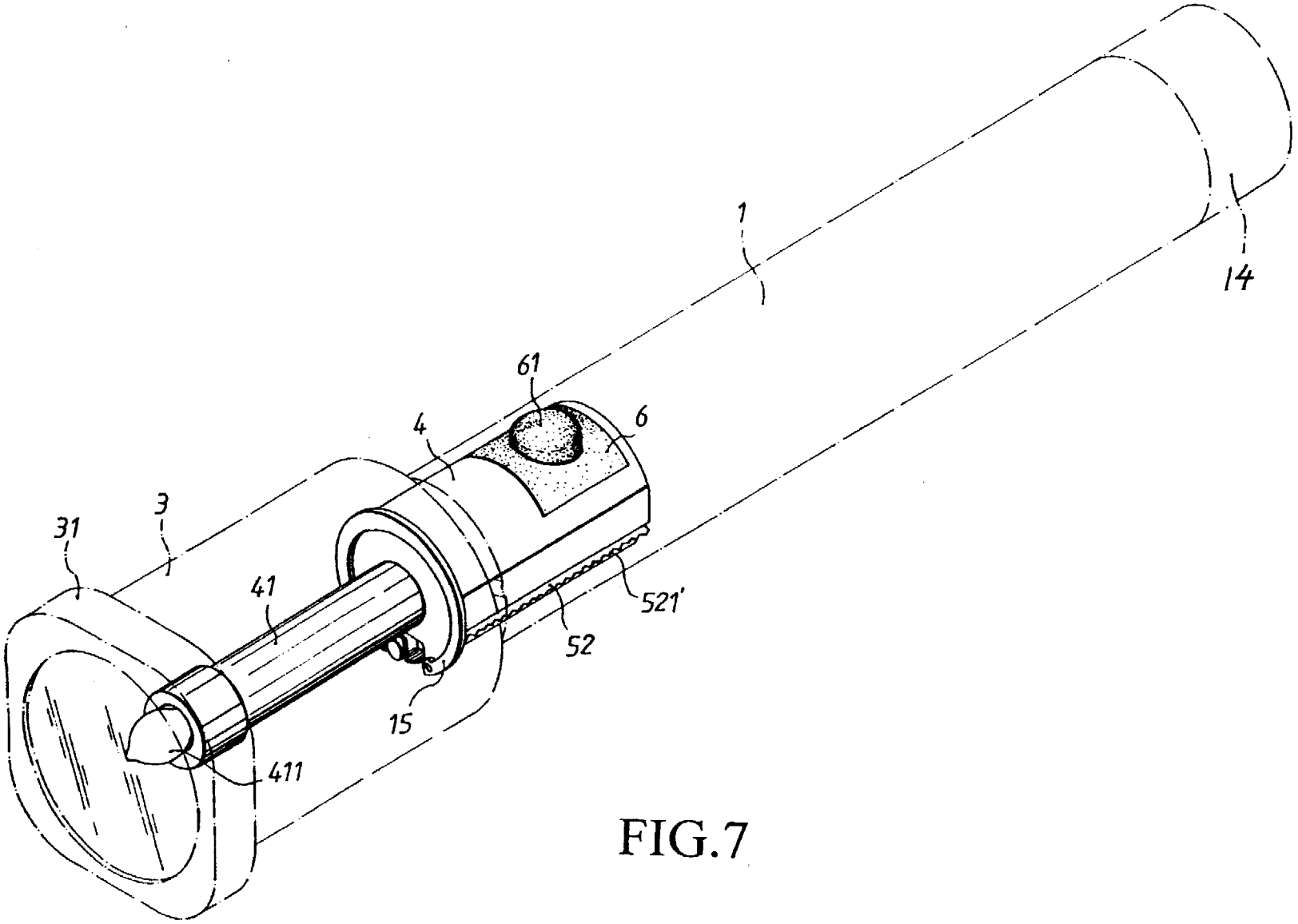
FIG. 7 is a perspective view showing the positioning assembly of the water proof switch socket which has been completely assembled.
Figure 8:
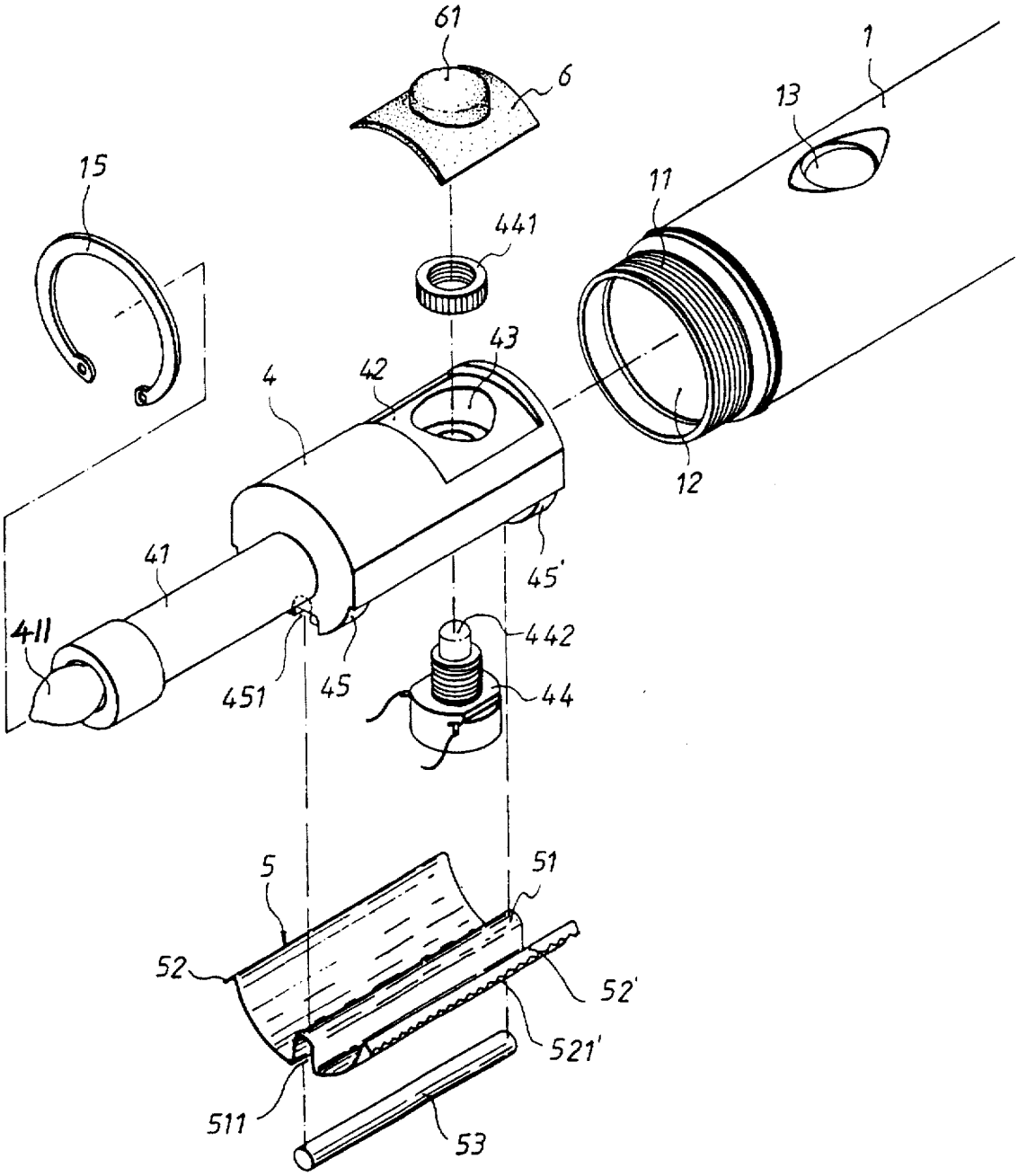
FIG. 8 is an exploded perspective view showing the positioning assembly of the water proof switch socket.
Figure 9:
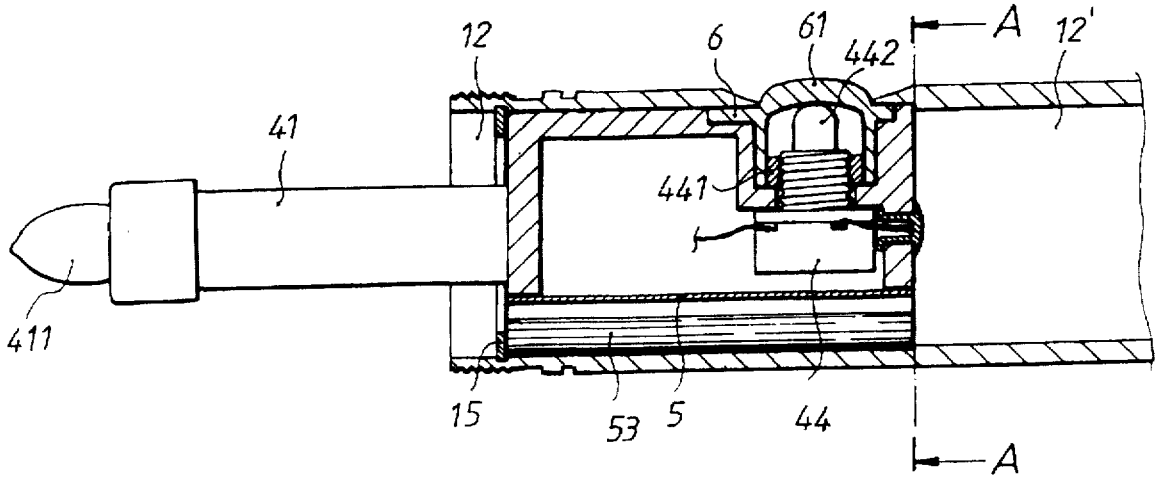
FIG. 9 is a cross sectional view showing the positioning assembly of the water proof switch socket.
Figure 10:
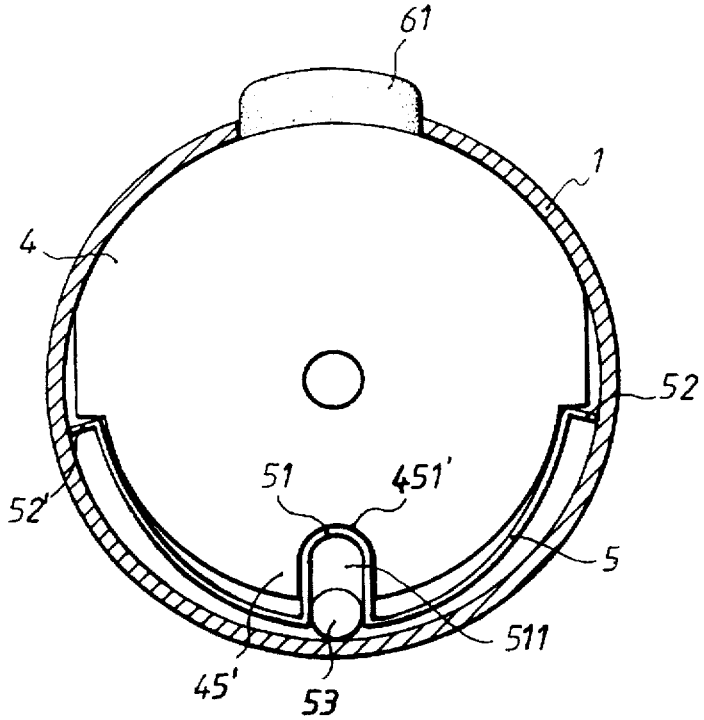
FIG. 10 is a cross sectional view taken along line A—A in FIG. 9.

The operation of the telescopic assembly is described below. When the shade 3 is rotated, by the slidable engagement between the projected bosses 342 of the shade 3 and the spiral grooves 23 of the headlight housing 2 causes the shade 3 to be moved outward gradually and it will stop only when the projected bosses 342 are retained within the retaining slots 231. Meanwhile, the projected tabs 22 are also retained with the groove 341 via the cutout 331 of the shade 3, as shown in FIG. 6. By this arrangement, the bulb 411 leaves the reflective mask 32 and enter the shade 3, consequently, the emitted light can be seen from the transparent shade 3. In light of this, the flashlight can be used a warning light, traffic signal baton etc. When the shade 3 is rotated in counter direction, the projected bosses 342 will be released from the retaining slots 231 of the spiral grooves 22 and moves back toward its original position until the bulb 411 enters again into the reflective mask 32, as shown in FIG. 5, then the flashlight can be used for normal application.

The assembling of the positioning assembly of the water proof switch socket is performed according to the following procedures. Firstly, the push button element 44 of the switch socket 4 is extended beyond the push button receiving hole 43, then a retaining ring 441 is applied to lock it. Then the push button plate 6 is disposed above the recessed portion 42 of the switch socket 4 such that the push button cap 442 of the push button element is enclosed by the bottom of the projected button 61. Then this resulting switch socket 4 is disposed into the stepped chamber 12 of the barrel 1 wherein the biasing plate 5 is pressed inward such that the rib 51 of biasing plate 5 is seated within the slots 451, 451' of the divergent stepped walls 45, 45' of the switch socket 4. The flaps 52, 52' are biased against the inner wall of the barrel 1, and a C-shape retaining clip 15 is applied to a retaining slot at the front wall of the stepped chamber 12 of the barrel 1. On the other hand, the opposite side of the C-shape retaining clip 15 is held against the stepped surface of the switch socket 4. Accordingly, the switch socket 4 can be securely positioned. Besides, the push button cap 442 of the push button element 44 of the switch socket 4 is right under the bottom of the projected button 61 of the water proof push button 6 which in turn extends outward of the push button hole 13 of the barrel 1. As a result, a water proof effect is attained.

Furthermore, the groove 511 defined by the projected rib 51 of the biasing plate 5 can be disposed with a positioning rod 53 such that the biasing plate 5 can be securely positioned. On the other hand, the edges of the flaps 52, 52' of the biasing plate 5 can be configured with zigzag arrangement which may provide an enhanced engagement with the inner wall of the barrel 1 of the flashlight.

According to one aspect of this invention, the shade 3 can be configured with a square cross section which can prevent the flashlight from rolling along a flat surface, such as a desk. The potential risk of being damaged is therefore reduced. It shall be appreciated that other shapes are also applicable. The number of the projected tabs 22 of the headlight housing 2 and the spiral grooves 23 can be increased or reduced according to the site requirements. Furthermore, the number of the cutouts 331 of the first projected rib 33 of the shade 3 and the projected bosses 342 of the second projected rib 34 which may mesh with the retaining slots 231 331 may also be increased or decreased according to requirements. Normally, at least one is enough, but the preferred embodiment of the present invention has three.

I claim:

1. A flashlight comprising a telescopic assembly for shade and a positioning assembly for a waterproof switch socket, the telescopic assembly including:

a) a headlight housing of tubular configuration including a front end having at least one projected tab, a rear end having an inner threaded portion, and at least one spiral groove extending lengthwise along an outer wall of the housing with at least one retaining slot at one end of the spiral groove;

b) a flashlight barrel of tubular configuration including a front end and a rear end, an outer threaded portion at the front end of said barrel releasably engaging with the inner threaded portion of the housing, a pair of stepped chambers, a push button hole disposed at one of the stepped chambers, and a cover removably engaging with the rear end of the barrel; and c) a transparent hollow tubular shade for slidably receiving the headlight housing therein, the shade including a front end and a fear end, an outer threaded portion at the front end of the shade attaching a shade cover to retain a reflective mask, a plurality of spaced circumferential ribs within the rear end of the shade, the ribs collectively defining a pair of grooves therebetween, said grooves respectively receiving a gasket and a rubber ring, a first rib of the spaced circumferential ribs having at least one cutout formed therein and engaged by the projected tab of the housing, and a second rib of the spaced circumferential ribs having a boss thereon and slidably engaging along the spiral groove of the housing permitting the housing to be retracted within and extended from the shade upon rotation of the shade.

2. The flashlight of claim 1 wherein the positioning assembly includes:

a) a switch socket, a biasing plate and a waterproof push button disposed within the step chamber having the pushbutton hole;

b) the switch socket including a front end having a bulb socket and a bulb installed within the bulb socket, a rear end for connection to a battery, a recess portion disposed at an inner wall of the switch socket adjacent to the rear end of the switch socket, a pushbutton receiving hole formed in the recessed portion, the pushbutton extending through the receiving hole, a retaining ring securing the pushbutton to the recessed portion, a divergent stepped wall at the front end of the switch socket and a divergent stepped wall at the rear end of the switch socket, and each of the divergent stepped walls having a slot formed therein;

c) a biasing plate having a semicircular configuration and including a central rib for engaging the slots of the divergent stepped walls on a first side, the central rib defining a groove on a second side, and a pair of free ends of the biasing plate terminating in a pair of outwardly extending flaps; and d) a waterproof pushbutton plate including a projected button in a central portion thereof, the plate being disposed on the recessed portion of the switch socket and enclosing the push button receiving hole, the retaining ring, and the push botton.

3. The flashlight of claim 2 further including a positioning rod engaging within the groove of the biasing plate for securing the rib of the biasing plate within the slots of the divergent stepped walls.

4. The flashlight of claim 2 wherein the flaps each includes an edge for engagement with an inner wall of the flashlight barrel.

* * * * *